United States Patent [19]

Itow et al.

[11] Patent Number: 4,527,995

[45] Date of Patent: Jul. 9, 1985

[54] FUEL BLENDED WITH ALCOHOL FOR DIESEL ENGINE

[75] Inventors: Koichiro Itow; Kunihiko Komiyama, both of Oyama, Japan

[73] Assignee: Kabushiki Kaisha Komatsu Seisakusho, Tokyo, Japan

[21] Appl. No.: 609,914

[22] Filed: May 14, 1984

[51] Int. Cl.[3] ..... C10L 1/18

[52] U.S. Cl. ..... 44/56; 44/57; 44/77

[58] Field of Search ..... 44/56, 57, 77

[56] References Cited

U.S. PATENT DOCUMENTS

| | | | |
|---|---|---|---|
| 1,570,060 | 1/1926 | Hammond | 44/56 |
| 1,699,355 | 1/1929 | Hammond | 44/56 |
| 1,713,530 | 5/1929 | Hammond | 44/56 |
| 3,211,539 | 10/1965 | Phillips | 44/77 |
| 4,207,078 | 6/1980 | Sweeney et al. | 44/56 |

*Primary Examiner*—Y. Harris-Smith

*Attorney, Agent, or Firm*—Armstrong, Nikaido, Marmelstein & Kubovcik

[57] ABSTRACT

A fuel blended with alcohol for use in a diesel engine, which comprises a petroleum fuel, methanol, and a higher alcohol having 10 to 16 carbon atoms as a mutual solvent for said petroleum fuel and methanol.

2 Claims, 25 Drawing Figures

FUEL BLENDED WITH ALCOHOL FOR DIESEL ENGINE

BACKGROUND OF THE INVENTION

1. Field of the Invention

This invention relates to a fuel blended with alcohol for use in a diesel engine.

2. Description of the Prior Art

A keen realization of the inevitable exhaustion of oil resources in the feature has directed public attention to alcohols as a substituent fuel. A study is pursued on the use of a petroleum fuel blended with alcohol for the operation of a diesel engine. In order for a blend of a petroleum fuel such as diesel fuel or heavy fuel with alcohol to be effectively used in the diesel engine, this blend fuel is desired to retain its behavior as a fuel stably for a long time.

Incidentally, the alcohol and the petroleum fuel such as diesel fuel or heavy fuel exhibit poor miscibility to each other. When the two components are mixed, the resultant mixture is liable to phase separation. It is, therefore, difficult to obtain a stable fuel by mixing these two components.

It has been customary, therefore, to obtain a blend fuel containing about 20% by volume of ethanol by the additional incorporation therein of 5 to 10% of another lower alcohol like propanol as a mutual solvent.

However, the effective blending technique for the methanol-based blended fuels is not established, because the methanol-based blended fuels are decisively inferior to the ethanol-based blended fuels in terms of mutual solubility.

SUMMARY OF THE INVENTION

This invention, therefore, has been directed to the development of a mutual solvent for the petroleum fuel and methanol which are blended to produce a blended fuel advantageously useful as alcohol blend for the diesel engine.

An object of the present invention is to provide an economic, stable alcohol-blended fuel using methanol as alcohol, which excels in mutual miscibility of a petroleum fuel and methanol and which is useful in the diesel engine.

To accomplish the object described above, according to the present invention, there is provided an alcohol-blended fuel for the diesel engine which comprises a petroleum fuel, methanol, and a higher alcohol having 10 to 16 carbon atoms as the mutual solvent for the petroleum fuel and methanol.

DETAILED DESCRIPTION OF THE INVENTION

Figure 1:
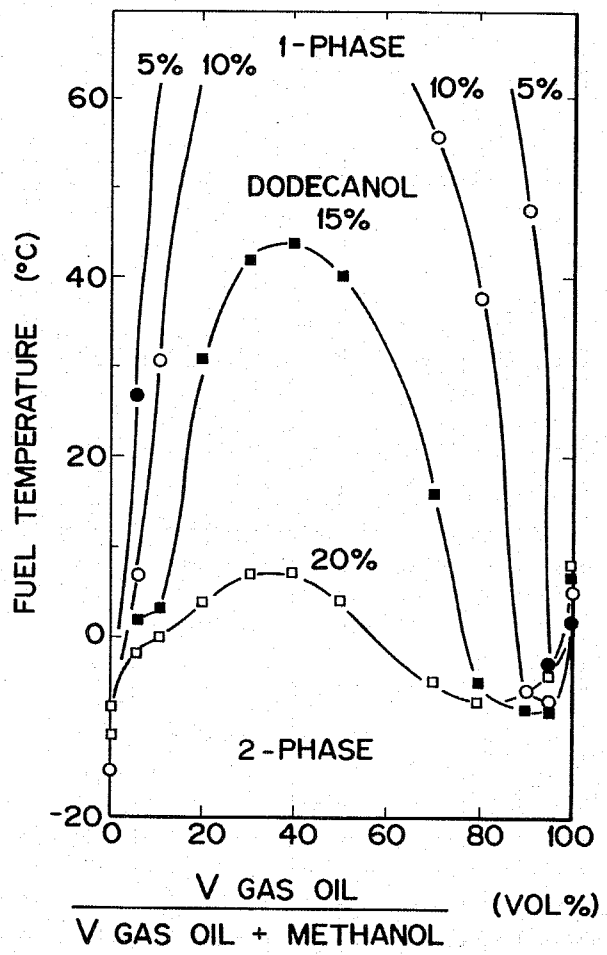
FIG. 1 is a graph showing the effect of the amount of dodecanol added upon the mutual solubility curve of gas oil (specific gravity, $\gamma=0.824$) and methanol in the resultant blended fuel.

Generally when two liquids which are only partially soluble in each other are mixed, there is observed a phenomenon in which the two liquids coexist as saturated solution in two phases. In this case, the composition of the mixture depends on the prevalent temperature and pressure of the system and may be defined in terms of mutual solubility. The relation between the temperature and the mutual solubility of the mixture under a fixed pressure (such as the atmospheric pressure) is expressed by a mutual solubility curve. In this mutual solubility curve, the upper portion of the curve represents a dissolved phase (one phase) and the lower portion represents the separated phases (two phases). The mutual solubility curve has its own maximum value at the temperature, Tc. When the temperature of the mixture is increased beyond this temperature Tc, the mixture becomes a perfect one-phase solution without reference to its composition. This particular temperature, Tc is defined as the critical solution temperature for the mixture. It has been known that when two components which have such low mutual solubility as described above are mixed, the mutual solubility of the components in the resultant mixture is improved and the critical solution temperature of the mixture is lowered by incorporating into the mixture a third component capable of simultaneously dissolving the first two components. This third component is generally referred to as a mutual solvent.

Also in the blended fuel consisting of an petroleum fuel and methanol, since the mutual solubility of the petroleum fuel and methanol is inferior, the mixture obtained by the blending of the two components tends to induce the phenomenon of the phase separation.

In order for the blended fuel of the petroleum fuel with methanol to be economical and, at the same time, capable of retaining its behavior stably for a long time, therefore, it is necessary to develop a mutual solvent with is inexpensive and also is capable of lowering the critical solution temperature of the blended fuel.

It has now been found that the higher alcohols having 10 to 16 carbon atoms may be advantageously used as the mutual solvent for the blended fuel of the petroleum fuel with methanol.

A search for substances which may be usable as mutual solvents for blended fuels of alcohols with petroleum fuels has revealed the following data.

TABLE 1

| Name of substance | Particulars of mutual solvents: Chemical formula | Specific gravity | Melting point | Boiling point |
|---|---|---|---|---|
| Gasoline | — | 0.73 | — | — |
| Benzene | $C_6H_6$ | 0.88 | 5.4° C. | 80.5° C. |
| Iso-octane | $C_8H_{18}$ | 0.69 | — | 99.3 |
| Propanol | $C_3H_7OH$ | 0.80 | −126.2 | 97.2 |
| Pentanol | $C_5H_{11}OH$ | 0.81 | −78.5 | 138.1 |
| Octanol | $C_8H_{17}OH$ | 0.82 | −16 | 194.0 |
| Decanol | $C_{10}H_{21}OH$ | 0.825 | −6 | 232.9 |
| Dodecanol | $C_{12}H_{25}OH$ | 0.83 | 24 | 259.0 |
| Cetanol | $C_{16}H_{33}OH$ | 0.835 | 49 | 189.0 |
| Ethyl ether | $(C_2H_5)_2O$ | 0.72 | −116.3 | 34.6 |

Figure 2:
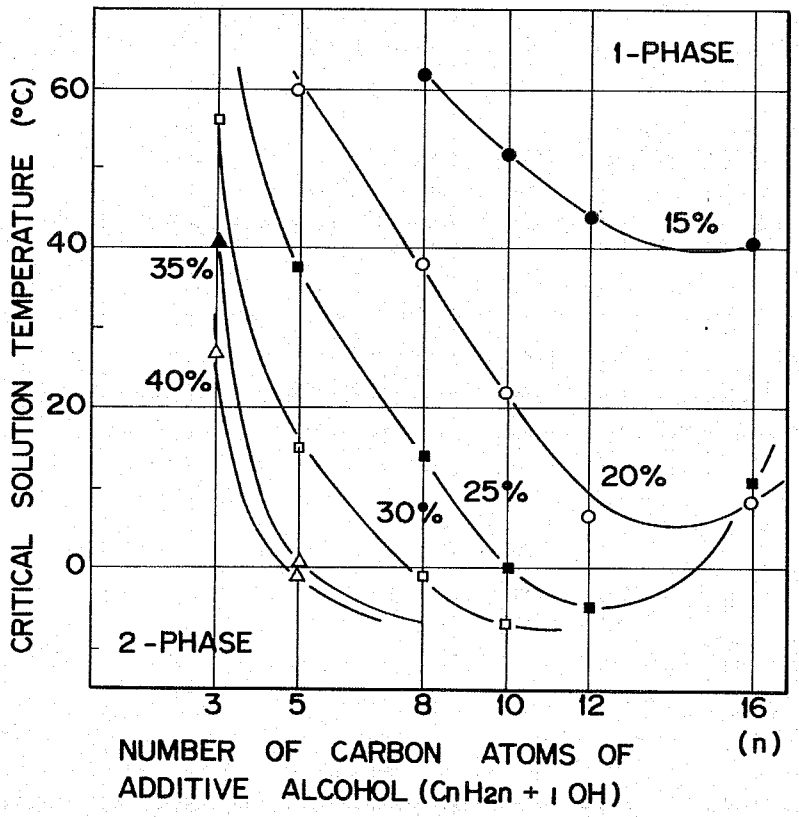
FIG. 2 is a graph showing the effect exerted upon the critical solution temperature, in relation to the amount of various alcohol added, by the number of carbon atoms of various alcohol in the blended fuel consisting of gas oil ($\gamma=0.824$), methanol, and various alcohol as a mutual solvent therefor.

It is noted from FIG. 1 and FIG. 2 that generally the critical solution temperature decreases in proportion as the mixing ratio of the mutual solvent with the blended fuel consisting of the alcohol and the petroleum fuel. And the rate of this decrease in the critical solution temperature is variable from one mutual solvent to another.

As the value for evaluating the improvement of the mutual solubility of the alcohol and the petroleum fuel by the addition of the mutual solvent, there is adopted the value, δ (°C./%), which represents the drop in the critical solution temperature to be brought about by the addition of the mutual solvent in an amount of 1% by volume. This value is designated as "mutual solubility improvement index".

The mutual solubility improvement index "δ" obtained by the incorporation of a varying mutual solvent in Table 1 above into the blended fuel consisting of ethanol or methanol as the alcohol and gas oil or heavy oil A (Type 1 according to JIS K-2205) as the petroleum fuel is shown in Table 2 below.

TABLE 2

| Mutual solvent | Mutual solubility improvement index, δ, by varying mutual solvent: Gas oil (γ = 0.824) Ethanol | Gas oil (γ = 0.824) Methanol | Heavy oil, A (γ = 0.846) Ethanol | Heavy oil, A (γ = 0.846) Methanol |
|---|---|---|---|---|
| Gasoline | 1.80 | 2.09 | 2.00 | — |
| Benzene | 2.60 | 3.55 | 2.70 | — |
| Iso-octane | 1.40 | — | 1.80 | — |
| Ethyl ether | — | 4.59 | — | — |
| Propanol | 1.95 | 3.25 | 1.68 | 3.11 |
| Pentanol | 3.77 | 4.71 | 3.07 | 4.48 |
| Octanol | 5.56 | 5.90 | 4.44 | 5.89 |
| Decanol | 6.37 | 6.76 | 5.18 | 6.56 |
| Dodecanol | 6.70 | 7.35 | 5.90 | 7.20 |
| Cetanol | 6.87 | 7.45 | — | — |

It is noted from Table 2 that the values of the mutual solubility improvement index "δ" are higher with such higher alcohols as cetanol, dodecanol, and decanol and lower with alcohols of smaller numbers of carbon atoms and such hydrocarbons as benzene, gasoline, and iso-octane, although they are more or less variable with the particular type of alcohol or petroleum fuel.

Of the blended fuels enumerated above, the ethanol-based blended fuels exhibit rather advantageous mutual solubility between ethanol and petroleum fuels. They, accordingly, permit adoption of mutual solvents having lower mutual solubility, such as gasoline. However, the methanol-based blended fuels are decisively inferior to the ethanol-based blended fuels in terms of mutual solubility. Thus, the higher alcohols which have 10 to 16 carbon atoms and have higher values of mutual solubility improvement index should be used as the mutual solvent for the preparation of the stable, methanol-based blended fuels usable in diesel engine.

By adopting the higher alcohols having 10 to 16 carbon atoms as the mutual solvent for a petroleum fuel and methanol in accordance with the present invention, the blended fuel of a petroleum fuel and methanol which has to date proved to be hardly feasible can be materialized advantageously. The methanol-based blended fuel according to the present invention excels in mutual solubility of the components and in stability, and relatively economy as well and, thus, may be advantageously used in the diesel engine.

Figure 3:
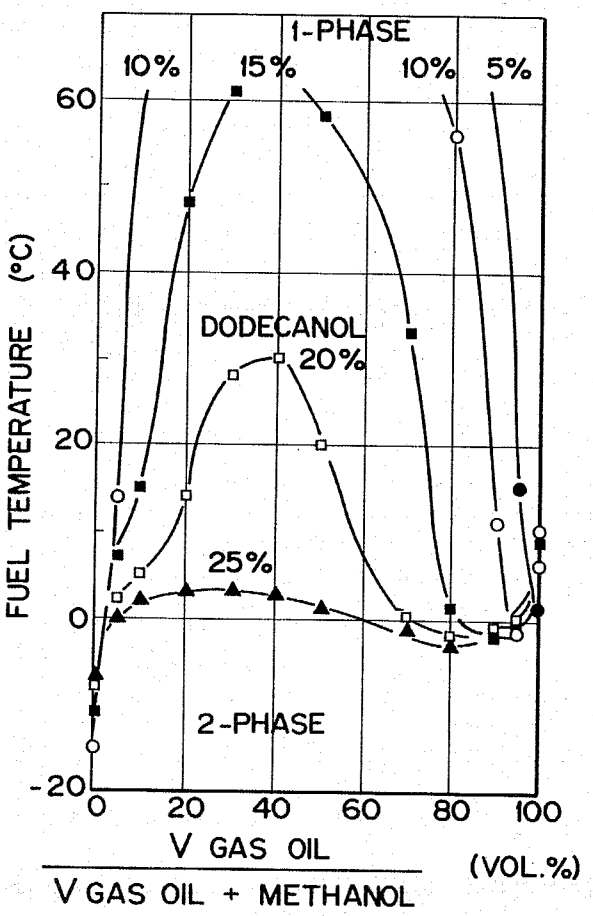
FIG. 3 is a graph showing the effect of the amount of dodecanol added upon the mutual solubility curve of gas oil ($\gamma=0.836$) and methanol in the resultant blended fuel.
Figure 4:
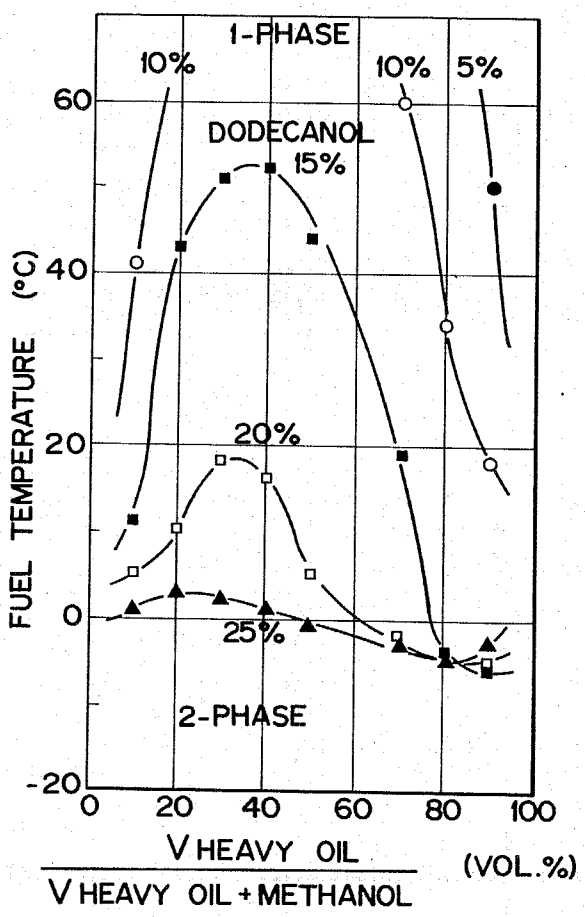
FIG. 4 is a graph showing the effect of the amount of dodecanol added upon the mutual solubility curve of heavy oil A ($\gamma=0.846$) and methanol in the resultant blended fuel.
Figure 5A:
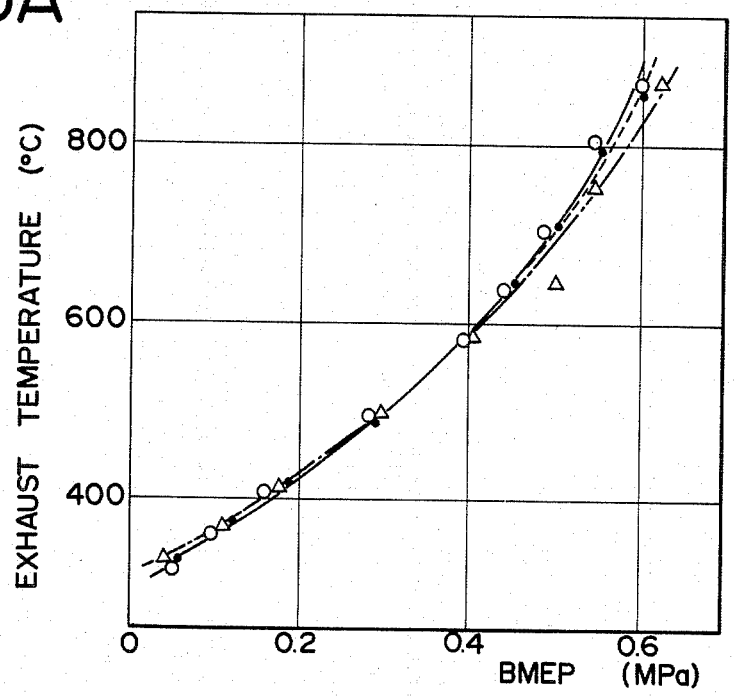
FIGS. 5A–5K are graphs showing the relation between the loads and the performances of the direct injection type diesel engine at the conditions of 2,500 r.p.m. of engine speed and 90° C. of water temperature, when used the blended fuel consisting of gas oil, methanol, and dodecanol as a mutual solvent.
Figure 5B:
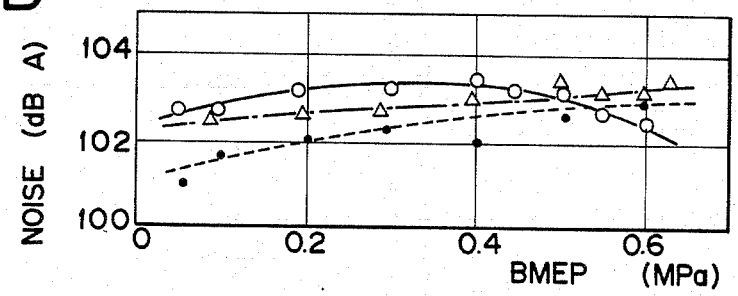
Figure 5C:
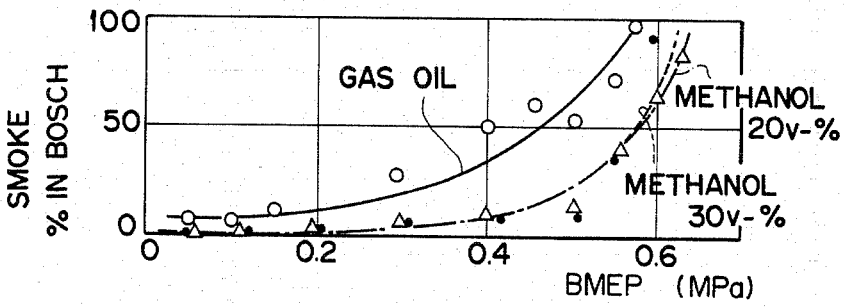
Figure 5D:
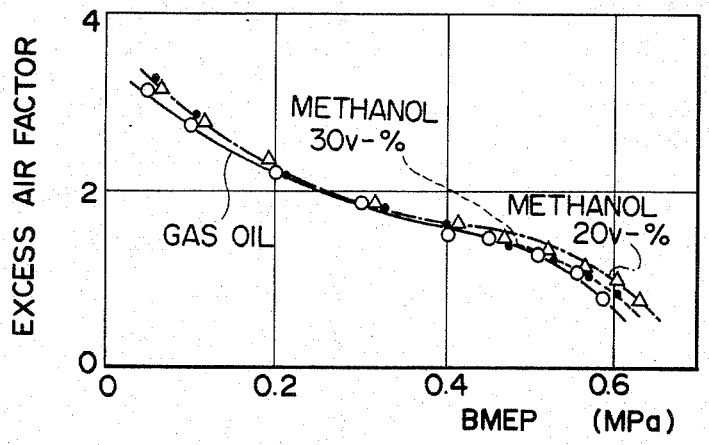
Figure 5E:
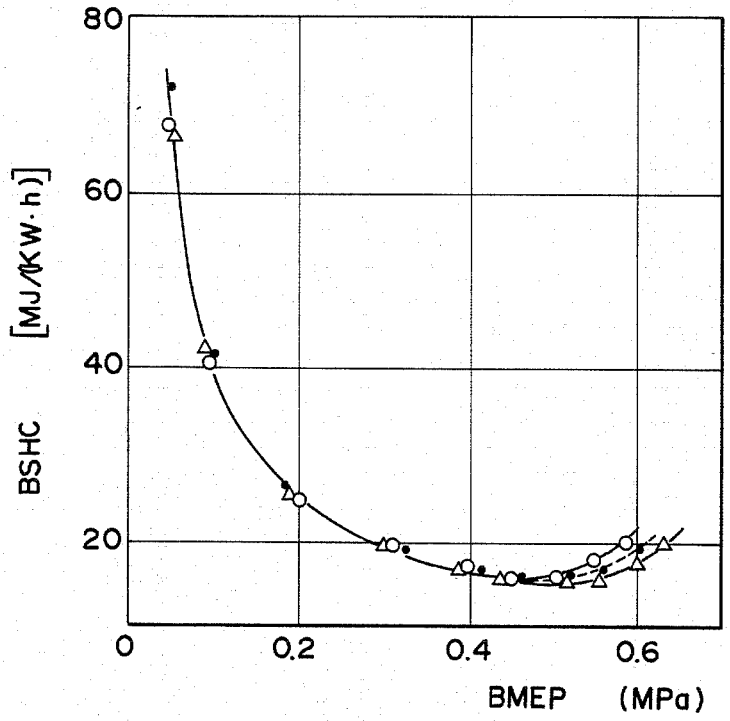
Figure 5F:
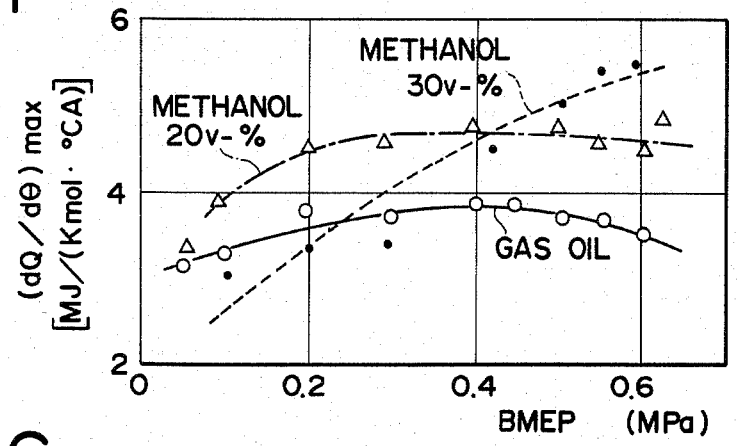
Figure 5G:
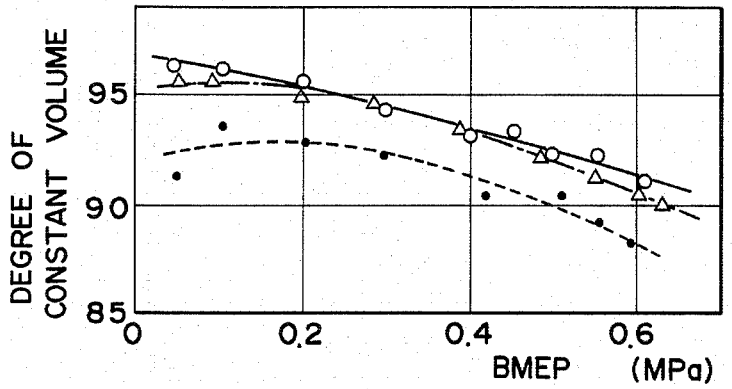
Figure 5H:
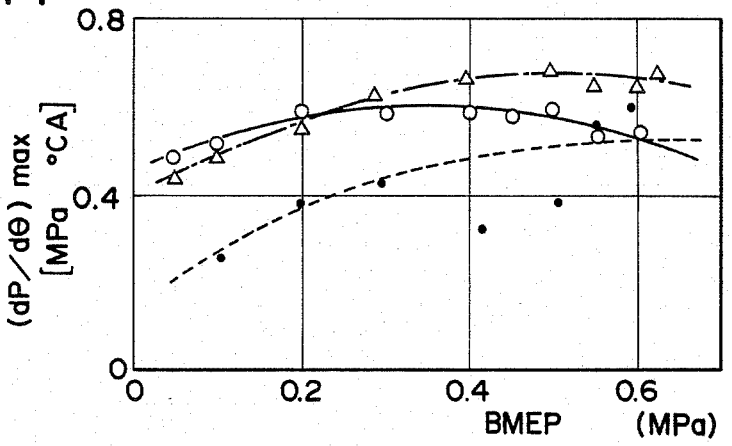
Figure 5I:
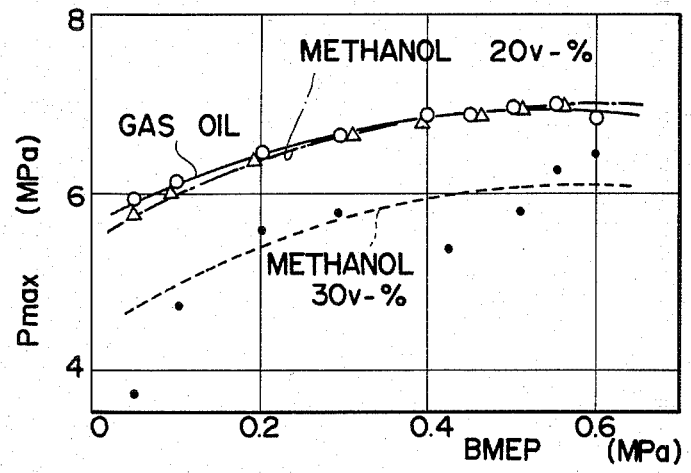
Figure 5J:
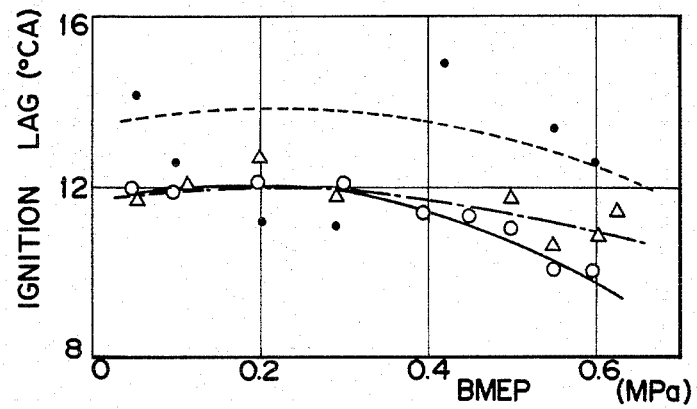
Figure 5K:
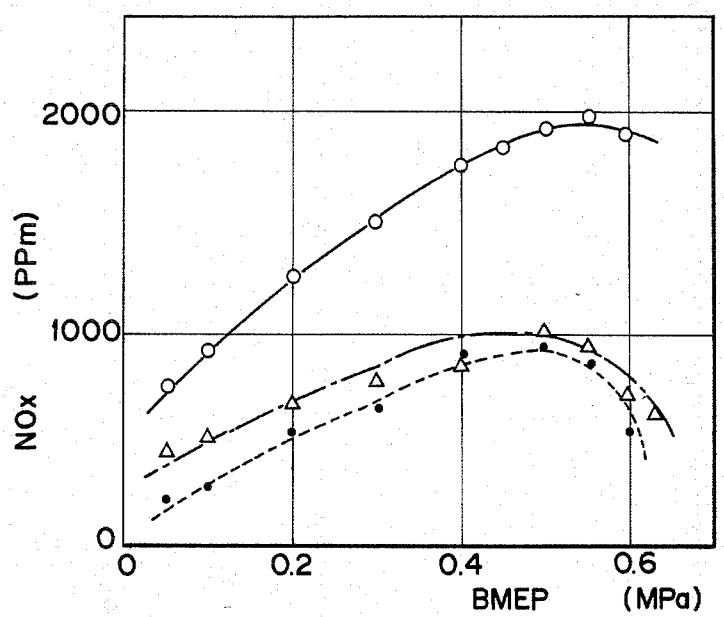
Figure 6A:
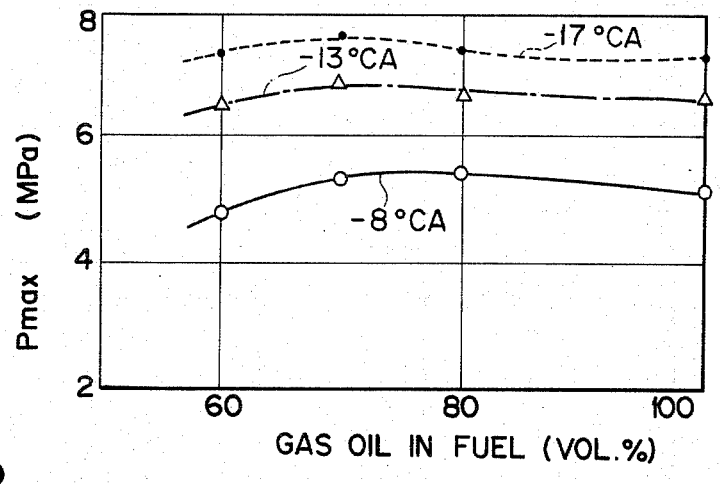
FIGS. 6A–6J are graphs showing the effects exerted upon the performance of the direct injection type diesel engine at the conditions of 2,500 r.p.m of engine speed, 90° C. of water temperature and 0.4 MPa of brake mean effective pressure (BMEP) by the mixing ratio of methanol in the used blended fuel consisting of gas oil, methanol, and dodecanol as a mutual solvent.
Figure 6B:
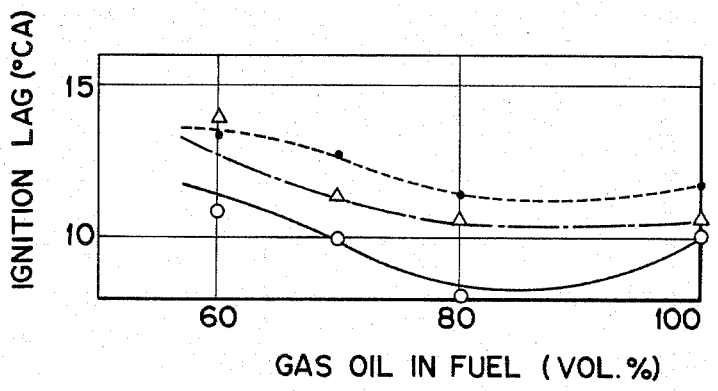
Figure 6C:
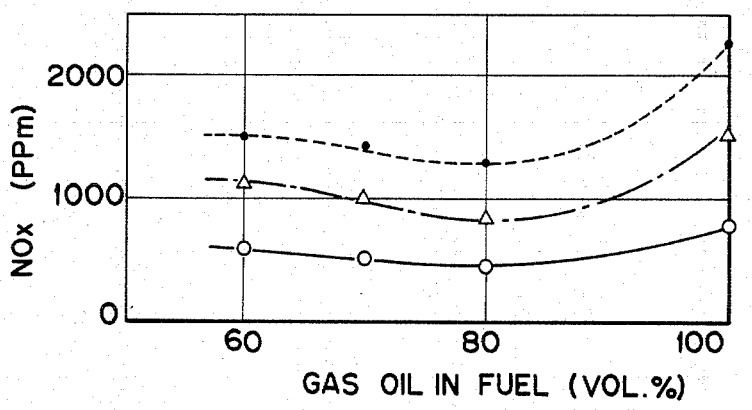
Figure 6D:
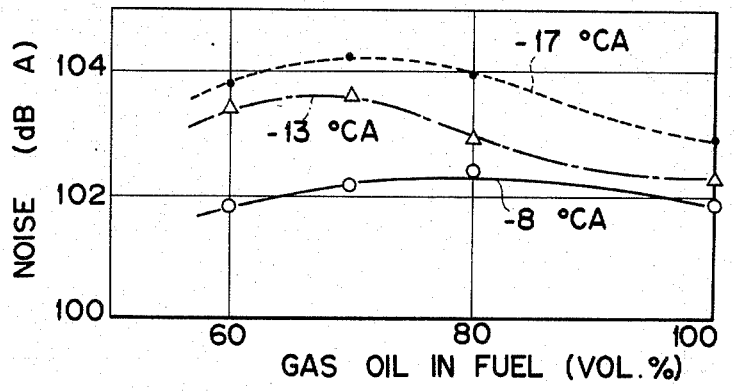
Figure 6E:
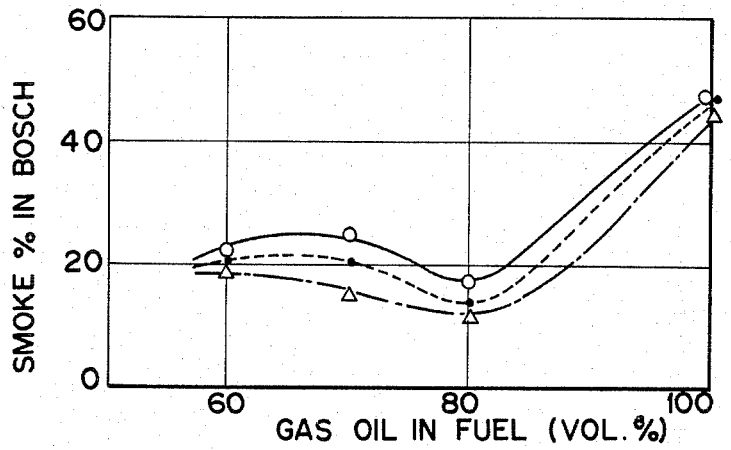
Figure 6F:
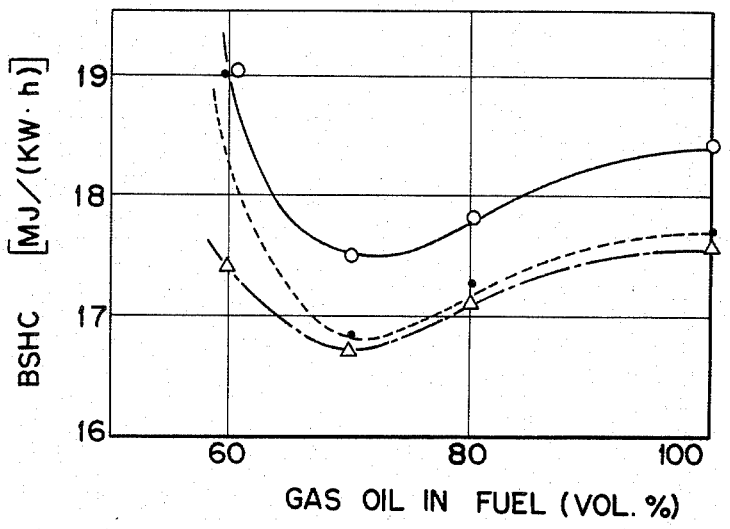
Figure 6G:
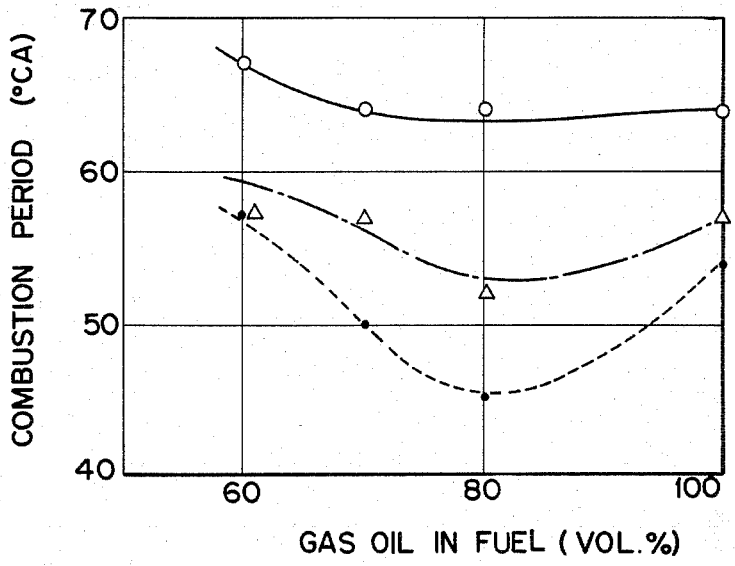
Figure 6H:
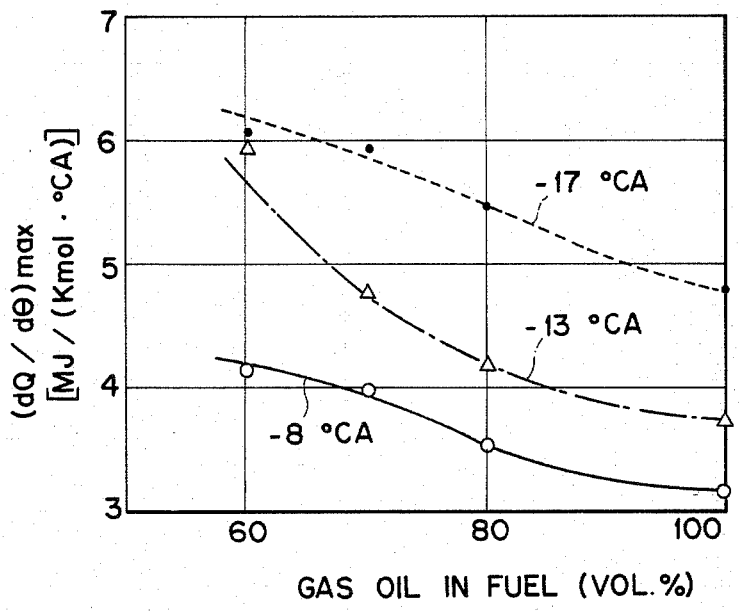
Figure 6I:
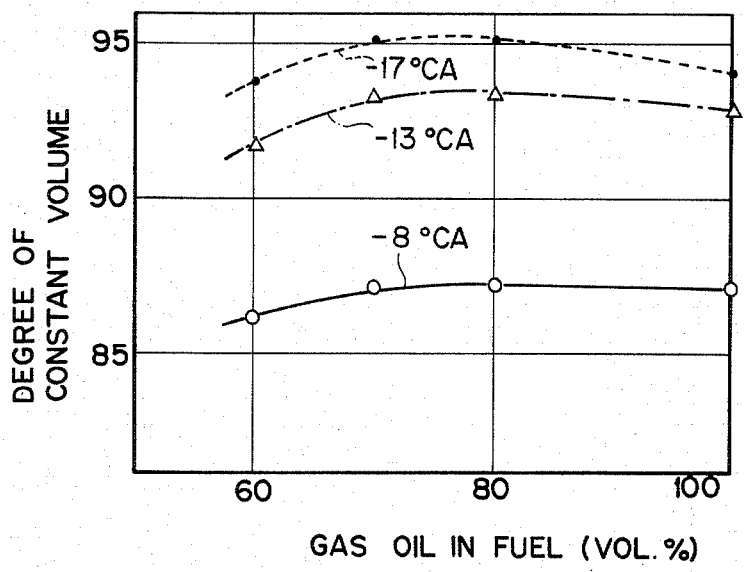
Figure 6J:
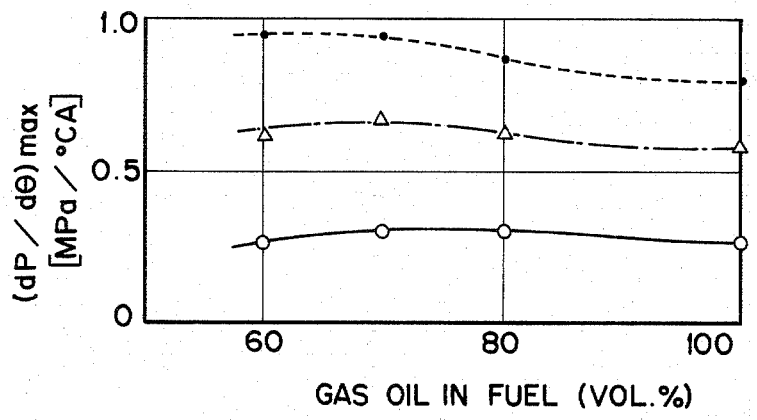

It is noted from the mutual solubility curves of varying blended fuels shown in the graphs of FIG. 1, FIG. 3 and FIG. 4 that the critical solution temperatures decrease with the increasing amounts of dodecanol added as the mutual solvent. This conclusion is clearly supported by the graph of FIG. 2. As shown in FIG. 2, when the critical solution temperature is lowered to a certain extent, any further increase in the amount of higher alcohol added does not manifest any noticeable increase in the effect. Thus, the mixing ratio of the higher alcohol as the mutual solvent is generally sufficient is the range not exceeding 35%. Preferably, the mixing ratio of the higher alcohol in the blended fuel is in the range of 5 to 25% by weight.

On the other hand, in view of the results of the performance tests of diesel engine described hereinafter, the mixing ratio of methanol in the blended fuel is in the range not exceeding 40% by volume, preferably from 10 to 30% by volume. The presence of excess amount of methanol in the blended fuel tends to induce the increase of noise and misfire in the diesel engine. The rest in the blended fuel is the petroleum fuel, but its mixing ratio in the blended fuel may be suitably selected in due consideration of the performance of diesel engine.

Examples of the petroleum fuel suitably used in the blended fuel of this invention include heavy fuels and diesel fuels both of varying grades. In the Japan Industrial Standard (JIS), the term "gas oil" is used to designate a refined mineral oil having a quality suitable to a fuel for internal combustion engines such as diesel engine, and gas oils are classified to five types depending on their pour points (JIS K2204). And also, in JIS K2205 the term "heavy oil" is used to designate a mineral oil having a quality suitable to a fuel for internal combustion engines, boilers, furnaces or the like, and heavy oils are classified to three types (A to C) depending on their kinematic viscosities. The "gas oil" roughly corresponds to diesel fuel of ASTM No. 1D and No. 2D in the United States. Needless to say, all the heavy fuels and the diesel fuels may be used as the petroleum fuel in the blended fuel of the present invention.

Now, the present invention will be described more specifically below with reference to performance tests of the diesel engine using the various blended fuels.

The performance tests of the direct injection type diesel engine were made by using the fuels shown in Table 3 below.

TABLE 3

| Fuel No. | Gas oil | Methanol | Dodecanol |
|---|---|---|---|
| 1 | 100 V % | — | — |
| 2 | 80 | 10 V % | 10 V % |
| 3 | 70 | 20 | 10 |
| 4 | 60 | 30 | 10 |

The each test was carried out at the conditions of 2,500 r.p.m. of engine speed and 90° C. of water temperature. The results are shown in FIGS. 5A–5K and FIGS. 6A–6J. In FIGS. 5A–5K the brake mean effective pressures (BMEP) are plotted as the load in the abscissae axis. FIGS. 6A–6J show the results of which the tests were carried out at the fixed load, 0.4 MPa of BMEP. It is noted from the results shown in FIGS. 5A–5K and FIGS. 6A–6J that the blended fuels according to the present invention do not exert any detrimental influence on the performances of the diesel engine.

What we claim is:

1. A fuel blended with alcohol for use in a diesel engine, which comprises from 85% to 25% by volume petroleum fuel, from 10% to 40% by volume methanol and from 5% to 35% by volume higher alcohol having 10 to 16 carbon atoms as a mutual solvent for said petroleum fuel and methanol.

2. The fuel according to claim 1, wherein the petroleum fuel is heavy fuel or diesel fuel.

* * * * *